US010533829B2

(12) United States Patent
Holmberg et al.

(10) Patent No.: US 10,533,829 B2
(45) Date of Patent: Jan. 14, 2020

(54) AUTOMATICALLY RESETTING TARGET DEVICE

(71) Applicants: Steven C. Holmberg, Kennedy, NY (US); Stephen W. Cass, Frewsburg, NY (US); Randal P. Stuart, Jamestown, NY (US)

(72) Inventors: Steven C. Holmberg, Kennedy, NY (US); Stephen W. Cass, Frewsburg, NY (US); Randal P. Stuart, Jamestown, NY (US)

(73) Assignee: Outdoor Gear Solutions, Inc., Falconer, NY (US)

( * ) Notice: Subject to any disclaimer, the term of this patent is extended or adjusted under 35 U.S.C. 154(b) by 0 days.

(21) Appl. No.: 16/107,609

(22) Filed: Aug. 21, 2018

(65) Prior Publication Data

US 2019/0056205 A1 Feb. 21, 2019

Related U.S. Application Data

(60) Provisional application No. 62/548,217, filed on Aug. 21, 2017.

(51) Int. Cl.

| | |
|---|---|
| ***F41J 7/04*** | (2006.01) |
| *F41J 1/10* | (2006.01) |
| *F41J 1/00* | (2006.01) |

(52) U.S. Cl.
CPC .. *F41J 7/04* (2013.01); *F41J 1/00* (2013.01); *F41J 1/10* (2013.01)

(58) Field of Classification Search
CPC ..... F41J 1/00; F41J 1/10; F41J 7/04
USPC ..... 273/390–392, 406, 407
See application file for complete search history.

(56) References Cited

U.S. PATENT DOCUMENTS

| | | | | |
|---|---|---|---|---|
| 1,424,632 A * | 8/1922 | Fenton | F41J 7/04 273/392 |
| 1,845,609 A * | 2/1932 | Knipper | F41J 7/04 273/388 |
| 2,133,552 A | 10/1937 | Long | |
| 2,967,712 A * | 1/1961 | Breitenfeldt | F41J 7/04 248/156 |

(Continued)

*Primary Examiner* — Mark S Graham
(74) *Attorney, Agent, or Firm* — The Bilicki Law Firm, PC

(57) ABSTRACT

An automatically resetting target device includes a target arm having a target end, a pivot end and a length therebetween, a target support member for pivotally supporting the pivot end of the target arm, and an automatically resetting mechanism. The automatically resetting mechanism includes a center support member attached to the target support member and biasing member having a first end and a second end, the first end attached to a point along the length of the target arm and the second end attached to an attachment member spaced apart from the pivot end of the target arm, wherein the biasing member passes across the pivot end of the target arm and causes the target arm to move from a first ready position to a second ready position when an outside force from a projectile is applied to the target. The automatically resetting target device assists one or more targets into a desired location securely and allows one or more users, through the energy of a projectile, to shoot and reset a target without moving from a shooting position. The target device also provides a method for enhancing shooting skills while also allowing two users to compete with one another.

28 Claims, 6 Drawing Sheets

(56) References Cited

U.S. PATENT DOCUMENTS

| | | | | | |
|---|---|---|---|---|---|
| 3,915,454 | A * | 10/1975 | Saunders | F41J 7/04 | 273/127 R |
| 3,979,118 | A * | 9/1976 | Saunders | F41J 7/04 | 273/388 |
| 4,093,227 | A * | 6/1978 | Saunders | F41J 7/04 | 273/388 |
| 4,373,733 | A * | 2/1983 | Smith, Jr. | F41J 7/04 | 273/381 |
| 4,726,593 | A | 2/1988 | Wade | | |
| 6,398,215 | B1 * | 6/2002 | Carroll | F41J 1/10 | 273/108 |
| 6,478,301 | B1 | 11/2002 | Witmeyer | | |
| 6,994,349 | B2 | 2/2006 | Lambert et al. | | |
| 8,807,570 | B1 | 8/2014 | Zalar | | |
| 9,163,912 | B1 * | 10/2015 | Stark | F41J 1/10 | |
| 9,574,855 | B2 * | 2/2017 | Davis | F41J 5/205 | |
| 10,018,450 | B2 * | 7/2018 | Loetz, Jr. | F41J 7/04 | |
| 2005/0001381 | A1 | 1/2005 | Lambert et al. | | |
| 2009/0174147 | A1 * | 7/2009 | Saunders | F41J 3/0004 | 273/392 |
| 2015/0260486 | A1 * | 9/2015 | Trimbath | F41J 7/04 | 273/407 |
| 2016/0018197 | A1 | 1/2016 | Dyck | | |

* cited by examiner

AUTOMATICALLY RESETTING TARGET DEVICE

FIELD OF ART

The present disclosure relates generally to shooting targets. In particular, the disclosure relates to an automatically resetting target device including a spring mechanism to assist a target into a desired location securely and to allow a user or users through the energy of a projectile to shoot and reset a target without moving from a shooting position.

BRIEF SUMMARY

An automatically resetting target device includes a target arm having a target end, a pivot end and a length therebetween, a target support member for pivotally supporting the pivot end of the target arm, and an automatically resetting mechanism. The automatically resetting mechanism includes a center support member attached to the target support member and biasing member having a first end and a second end, the first end attached to a point along the length of the target arm and the second end attached to an attachment member spaced apart from the pivot end of the target arm, wherein the biasing member passes across the pivot end of the target arm and causes the target arm to move from a first ready position to a second ready position when an outside force from a projectile is applied to the target.

In some embodiments, the attachment member is affixed to the center support member. Further, the center support includes a first end that contacts the target arm in a first ready position and a second end that contacts the target arm in a second ready position and acts as a barrier to protect the biasing member and pivot end of the target arm. In some embodiments the biasing member is a spring and the attachment member is a spring ring. In addition, some embodiments include a plurality of target arms spaced along the center support.

In general, the automatically resetting target device provides a spring mechanism to assist targets into a desired location securely and allow a user through the energy of a projectile to shoot and reset a target without moving from a shooting position and provide a method for enhancing shooting skills while also allowing two users to compete with one another.

The automatically resetting target device also provides a method to mechanically assist a target into a desired position and allows a user to shoot and reset a target without having to move from a shooting position. It also provides a method to secure a target in a desired location and provides a target that may move and can change from the energy of a projectile. Further, the device allows two users to shoot against one another, allows one or more users to enhance their shooting skills, and provides a device that does not solely rely upon gravity.

The embodiments to the invention may be represented in the form illustrated in the accompanying drawings. However, as the drawings are illustrative only, changes may be made in the specific construction illustrated and described within the scope of this application. It is to be understood that the embodiments of the invention are not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various aspects of the embodiments of the invention will become fully appreciated as the same becomes better understood when considered in conjunction with the accompanying drawings, in which like reference characters designate the same or similar parts throughout the several views, and wherein.

DETAILED DESCRIPTION OF THE EMBODIMENTS

Figure 1:
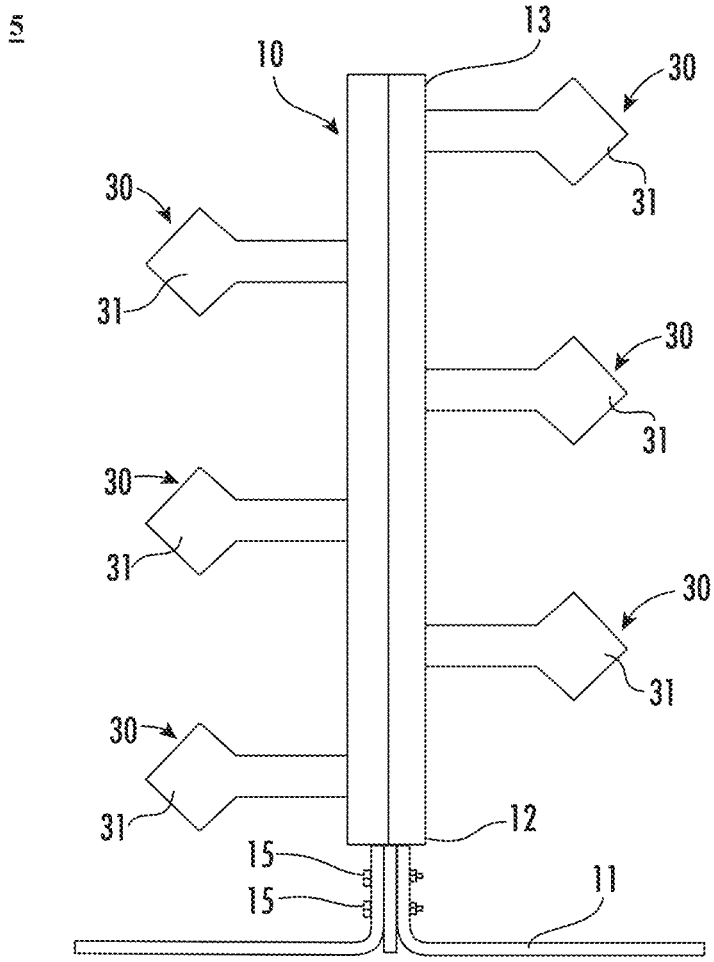
FIG. 1 is a front view of one embodiment showing multiple automatically resetting shooting targets.

Turning now descriptively to the drawings, in which similar reference characters denote similar elements throughout the several views, the figures illustrate an automatically resetting target device 5 with a center support 10, a target support 20 that is attached to center support 10 and a target arm 30 that is attached to the target support 20 to allow one or more users to shoot the target and move the target to an alternative location though the energy of a projectile and the assistance of a biasing member, such as a spring 34.

In the embodiment shown in FIG. 1, multiple target arms 30 are provided on the target device 5. A center support is shown as an elongated structure having a first end 12 and second end 13. Center support 10 is a straight structure in the embodiment shown; however, various non-straight structures may be utilized for center support 10. In some embodiments the function of center support is to support one or more targets and provide a barrier to protect the mechanisms, such as the biasing members or springs, from projectiles being shot from the user. Connected to center support 10 at the desired location for a target is the target support. Center support may be a long straight structure made from metal, however other structures and materials may be used. In one embodiment, center support 10 is constructed of an angle iron, which may promote safe projectile deflection as well as provide protection to spring or biasing member.

Figure 4:
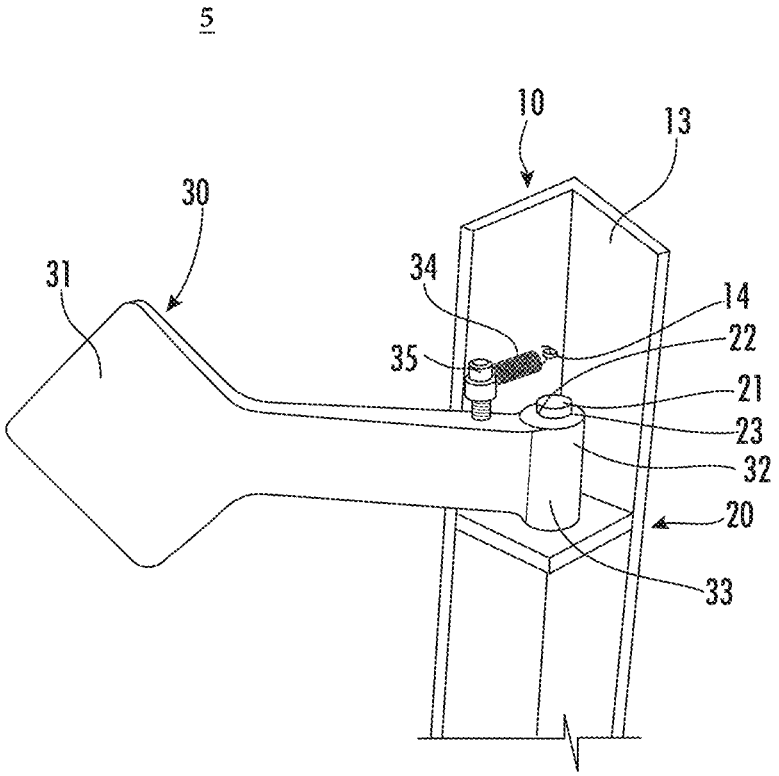
FIG. 4 is an upper perspective view of an embodiment of the automatically resetting target device with a target arm in a first ready position.
Figure 5:
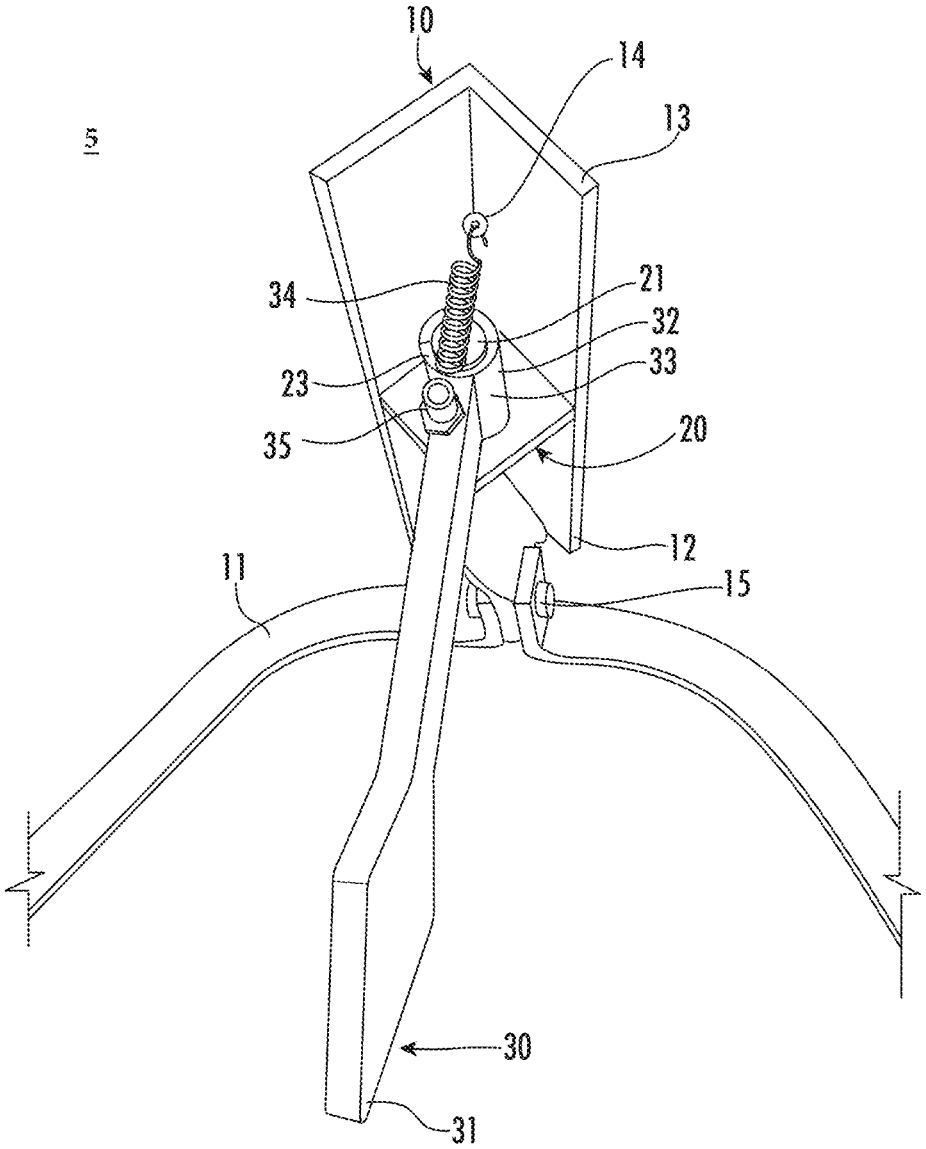
FIG. 5 is an upper perspective view of the automatically resetting target device with the target arm in a center moving position after a projectile has struck a target end.
Figure 6:
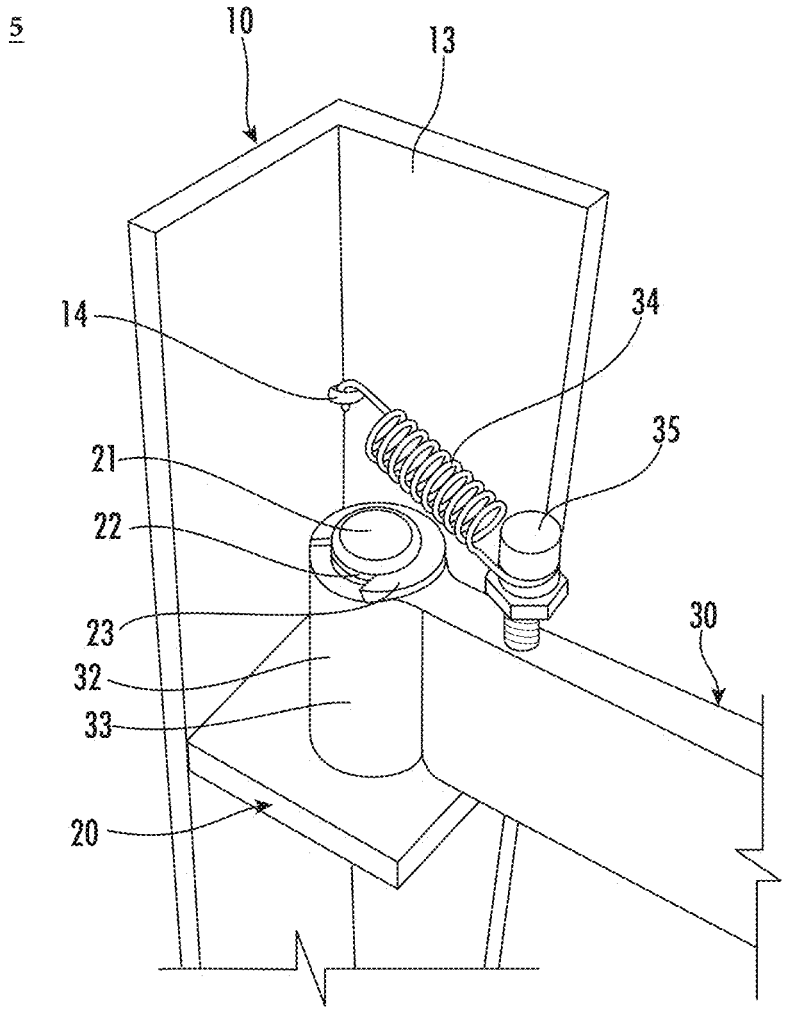
FIG. 6 is an upper perspective view of the automatically resetting target device in a second ready position.

As illustrated in FIGS. 1, 2, 3 and 5 of the drawings, center support 10 first end 12 attaches to a stand 11 using fasteners such as stand bolts. In one embodiment, center support 10 is V-shaped and includes a corner with an attachment member, such as a spring ring 14, as illustrated in FIGS. 4, 5 and 6 of the drawings. A biasing member or spring 34 is attached to spring ring 14. Center support 10 may have many various shapes and structures and is not limited to those shown in the attached Figures.

Automatically resetting target device 5 also includes a target support 20. Target support 20 is shown as a rectangular structure, however other various structures may be utilized for the target support 20. In the embodiments shown in the Figures, target support 20 includes an aperture for allowing a stud to be attached within the structure. The function of the target support is to support one or more targets 30 and to allow the targets to be mounted and attached to the automatically resetting target device 5.

Target support 20 may have many various shapes and structures. In particular, target support 20 may be a square or rectangular piece of flat metal that is welded or attached through various methods to center support 10 as shown in FIGS. 2, 3, 4, 5 and 6 of the drawings. Target support 20 allows a platform for target arm 30 to be placed and utilized as a moving target within the target support. A pivot stud 21 is attached to provide a pivot point for a target bushing 33 to be placed onto pivot stud 21, allowing a hinge type movement to target arm 30. Within pivot stud 21 is a stud groove 22, which when combined with retainer clip 23, prevents target arm 30 from coming off of the pivot stud 21, as shown in FIGS. 4, 5 and 6 of the drawings.

Target arm 30 is an elongated type structure having a target end 31 and a pivot end 32 with a length therebetween. In the embodiments illustrated, target arm 30 is a straight structure, however other various non-straight structures may be utilized. At the pivot end 32, target arm 30 may have a hole to install a stud 21 to secure a spring and a bushing to be attached to stud 21. The function of the target is to provide a user a place to aim and shoot a projectile while allowing the projectile and the biasing member 34 to move the target securely and consistently into another location, such as from a first ready position to a second ready position.

Target end 31 of target arm 30 is the portion of which a projectile should strike. The length of target arm 30 is a rectangular section that terminates at pivot end 32 with an integrated attached bushing 33, as shown in FIGS. 3, 4, 5 and 6 of the drawings. Bushing 33 is integrated into the target and allows the target to be placed onto the pivot stud 21 to create a back and forth hinge type movement. Located toward the pivot end 32 is spring stud 35 that is attached directly to target arm 30 as illustrated in FIGS. 3, 4, 5 and 6 of the drawings. Spring stud 35 provides a place to attach spring 34 and places spring 34 in a position to keep continuous pressure on target arm 30. Keeping target arm 30 in proximity against either side of center support 10 allows the target to be hit and moved to the opposite side of center support 10 without bouncing back or needing to be manually reset. The first end of spring 34 is attached to a spring ring 14 on center support 10. While under tension the second end of spring 34 is attached to the target spring stud 35 on the arm of target arm 30 for holding target arm 30 against center support 10. Target arm 30 can pivot on the pivot stud 21 a total of 180 degrees more or less until coming back into contact with center support 10. When target arm 30 responds to the energy of a projectile the target begins to move while the biasing force of spring 34 increases and spring 34 passes over or under the pivot stud 21 until target arm 30 reaches maximum equilibrium at which time the biasing force of spring 34 lessens bringing target arm 30 arm back into contact with center support 10 a total of 180 degree from where the target began. Thus, allowing the target to be shot from the second position. Target arm 30 may have many various shapes and structures that may be utilized effectively.

Figure 2:
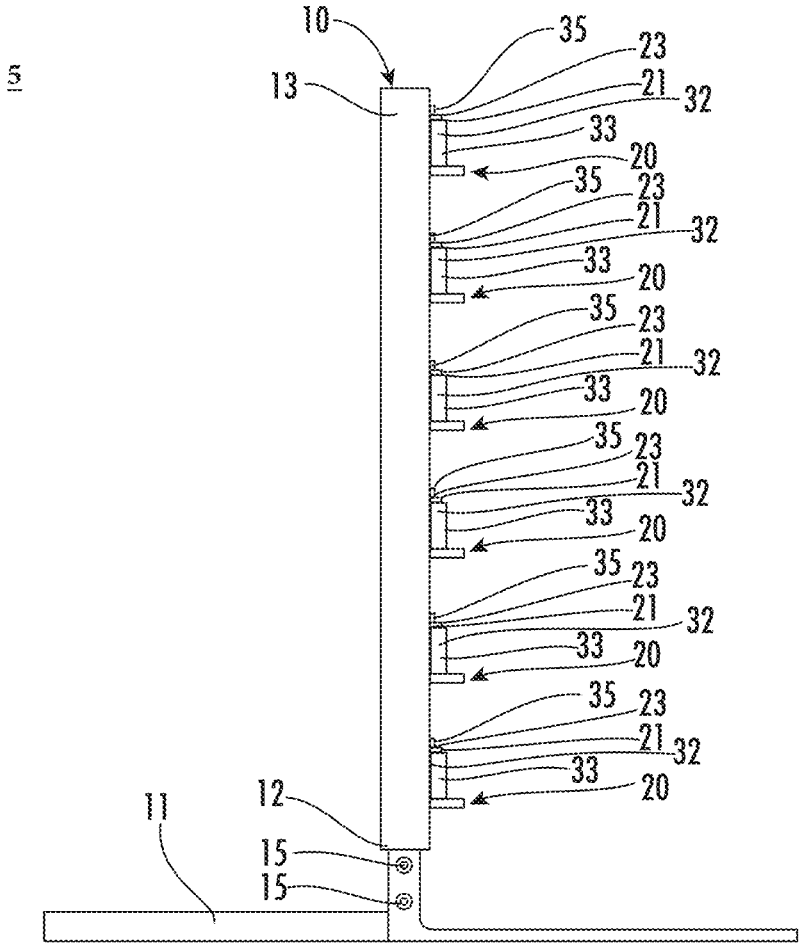
FIG. 2 is a side view of the embodiment shown in FIG. 1.
Figure 3:
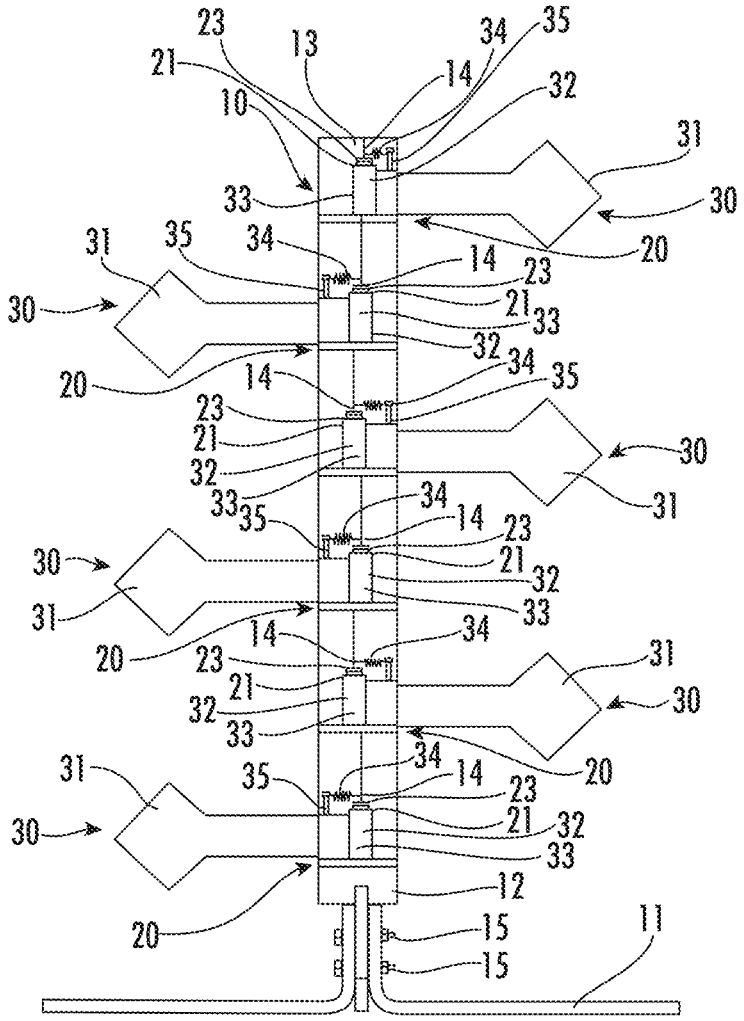
FIG. 3 is a rear view of the embodiment shown in FIGS. 1 and 2.

As illustrated in FIGS. 1, 2, 3 and 5 of the drawings center support 10 first end 12 is connected to stand 11 through the use of stand bolts 15. Connected to center support 10 is target support 20, as illustrated in FIGS. 2 and 3 of the drawings starting at first end 12 and going toward second end 13 of center support 10. Target support 20 are connected to the points where a target is located. Integrated directly in the target support is the pivot stud 21 which incorporates a stud groove 22 and a retainer clip 23 that secures target arm 30 to the target support 20. Connected to target support 20 is target arm 30 and the target end 31 is the projectile impact portion and is connected to pivot end 32 and bushing 33 which allows target arm 30 to be placed onto the pivot stud 21 and secured using the retainer clip 23. Connected to target arm 30 second end 32 is spring stud 35 which allows spring 34 to be connected to both spring studs 35 and spring ring 14 that is connected to center support 10 as illustrated in FIGS. 3, 4, 5 and 6 of the drawings.

In one embodiment center support 10 is illustrated with the long axis in a vertical position. In an alternative embodiment, the constant tension of spring 34 mechanism will allow center support 10 long axis to be placed in a horizontal position giving the user an up and down swing in lieu of a side to side target movement. It should be understood that center support may be positioned in various orientations, such as horizontal, vertical and any position therebetween since target device 5 does not rely on gravity for its functionality.

In operation, the user first sets up the target so that first end 12 of center support 10 is attached to stand 11 using stand bolts 15 to allow center support 10 to stand with the long axis in a vertical position as illustrated in FIGS. 1, 2 and 3 of the drawings. Target arm 30 pivot end 32 is placed onto pivot stud 21 and target support 20 and secured with the retainer clip 23 as illustrated in FIGS. 3, 4, 5 and 6 of the drawings. This allows target end 31 to be struck by a projectile and swing from one side of center support 10 to the opposite side. To prevent target arm 30 from bouncing back to the original position after being struck with a projectile and also preventing target arm 30 from being positioned directly behind center support 10 to be unable to be seen and struck by the user, spring 34 is attached to both spring stud 35 via the stud groove 22 to keep spring 34 in place and to spring ring 14 that is attached to center support 10, as illustrated in FIGS. 3, 4, 5 and 6 of the drawings. Spring ring 14 or other attachment member is positioned proximate to but spaced apart from the pivot end 32 of target arm 30, as shown attached to center support 10. The location of where spring 34 is attached to spring ring 14 and spring stud 35 and the pivot stud 21 provide a mechanism that allows target arm 30 to move freely from either position while continually maintaining tension on target arm 30 thus allowing it to rest against center support 10, thereby allowing a user to repeatedly hit the target and have it move to the opposite side of center support 10 and reset automatically, ready for the next impact. As illustrated in FIGS. 4-6, biasing member or spring 34 is attached to spring ring 14, which is positioned such that spring 34 passes across pivot end 32 of target arm when moving from a first ready position to a second ready position. Although shown passing above pivot end 32 of target arm 31, it should be understood that biasing member or spring may be configured to pass below pivot end 32, depending on the orientation of center support 10.

In general, spring 34 is under tension and taut wanting to pull target arm 30 back to center support 10 and into a ready position on the opposite side of center support 10 where it had previously been struck. FIG. 6 illustrates target arm 30 during the motion from one ready position on one a side of center support 10 or the beginning motion after being struck by a projectile in another ready position of another side of center support 10. Spring 34 is under light tension and target arm 30 is not touching center support 10. The first end of spring 34 is attached to a spring 14 on center support 10 while under tension the second end of spring 34 is attached to the target spring stud 35 on the arm of target arm 30 holding target arm 30 against center support 10. Target arm 30 can pivot on the pivot stud 21 a total of approximately 180 degrees until coming back into contact with center support 10. When target arm 30 responds to the energy of a projectile the target begins to move while the biasing force of spring 34 increases and spring passes over or under the pivot stud 21 until target arm 30 reaches maximum equilibrium at which time the biasing force of spring 34 lessens bringing target arm 30 arm back into contact with center support 10 a total of 180 degree from where the target began, allowing the target to be shot from the second ready position.

What has been described and illustrated herein is an embodiment of the invention along with some of its variations. The terms, descriptions and figures used herein are set forth by way of illustration only and are not meant as limitations. There are many variations possible within the spirit and scope of the embodiments of the invention in which all terms are meant in their broadest, reasonable sense unless otherwise indicated.

The invention claimed is:

1. An automatically resetting target device comprising:

a substantially linear target arm having a target end and a pivot end and a length therebetween;

a target support member for pivotally supporting the pivot end of the target arm; and an automatically resetting mechanism including:

a center support member attached to the target support member; and a biasing member having a first end and a second end and a length therebetween, said first end attached to a point along the length of the target arm spaced apart from the pivot end in a first direction, said second end attached to an attachment member spaced apart from the pivot end of the target arm in a second direction, wherein said length of said biasing member passes across the pivot end of the target arm and causes the target arm to move from a first ready position to a second ready position approximately 180 degrees from the first ready position when an outside force from a projectile is applied to the target end of the target arm.

2. The automatically resetting target device of claim 1, wherein the attachment member is affixed to the center support member.

3. The automatically resetting target device of claim 1, wherein the center support member includes a first end that contacts the target arm in a first ready position and a second end that contacts the target arm in a second ready position.

4. The automatically resetting target device of claim 1, wherein the center support member acts as a barrier to protect the biasing member and pivot end of the target arm.

5. The automatically resetting target device of claim 1, wherein the biasing member is a spring and the attachment member is a spring ring.

6. The automatically resetting target device of claim 1, including a plurality of target arms spaced along the center support member.

7. The automatically resetting target device of claim 1, wherein the target support member includes a pivot stud attached thereto for a target bushing, thereby allowing a hinge type movement of the target arm.

8. The automatically resetting target device of claim 1, wherein the center support member is positioned approximately vertically.

9. The automatically resetting target device of claim 1, wherein the center support member is positioned approximately horizontally.

10. In an automatically resetting target device having a substantially linear target arm with a target end and a pivot end and a length therebetween and a target support member for pivotally supporting the pivot end of the target arm, an automatically resetting mechanism comprising:

a center support member spaced apart from the pivot end of the target arm;

a biasing member having a first end and a second end and a length therebetween, said first end attached to a point along the length of the target arm spaced apart from the pivot end in a first direction, said second end attached to an attachment member spaced apart from the pivot end of the target arm in a second direction, wherein said length of said biasing member passes across the pivot end of the target arm and causes the target arm to move from a first ready position to a second ready position approximately 180 degrees from the first ready position when an outside force from a projectile is applied to the target end of the target arm.

11. The automatically resetting mechanism of claim 10, wherein the attachment member is affixed to the center support member.

12. The automatically resetting mechanism of claim 10, wherein the center support member includes a first end that contacts the target arm in a first ready position and a second end that contacts the target arm in a second ready position.

13. The automatically resetting mechanism of claim 10, wherein the center support member acts as a barrier to protect the biasing member and pivot end of the target arm.

14. The automatically resetting mechanism of claim 10, wherein the biasing member is a spring and the attachment member is a spring ring.

15. The automatically resetting mechanism of claim 10, wherein the target support includes a pivot stud attached thereto for a target bushing, thereby allowing a hinge type movement of the target arm.

16. The automatically resetting mechanism of claim 10, wherein the center support member is positioned approximately vertically.

17. The automatically resetting mechanism of claim 10, wherein the center support member is positioned approximately horizontally.

18. A method of target shooting with an automatically resetting target device having a substantially linear target arm having a target end and a pivot end and a length therebetween, a target support member for pivotally supporting the pivot end of the target arm, and an automatically resetting mechanism including: a center support member spaced apart from the pivot end of the target arm; and a biasing member having a first end and a second end and a length therebetween, said first end attached to a point along the length of the target arm spaced apart from the pivot end in a first direction, said second end attached to an attachment member spaced apart from the pivot end of the target arm in a second direction, wherein said length of said biasing member passes across the pivot end of the target arm and causes the target arm to move from a first ready position to a second ready position approximately 180 degrees from the first ready position when an outside force from a projectile is applied to the target end of the target arm, said method comprising:

firing a first projectile to contact the target end of the target arm in a first ready position and thereby rotating said target arm rearward to a second ready position; and firing a subsequent projectile to contact the target in the second ready position and thereby move the target rearward back to the first ready position.

19. The method of target shooting of claim 18, wherein the attachment member is affixed to the center support member.

20. The method of target shooting of claim 18, wherein the center support member includes a first end that contacts the target arm in a first ready position and a second end that contacts the target arm in a second ready position.

21. The method of target shooting of claim 18, wherein the center support member acts as a barrier to protect the biasing member and pivot end of the target arm.

22. The method of target shooting of claim 18, wherein the biasing member is a spring and the attachment member is a spring ring.

23. The method of target shooting of claim 18, including a plurality of target arms spaced along the center support member.

24. The method of target shooting of claim 18, wherein the target support includes a pivot stud attached thereto for a target bushing, thereby allowing a hinge type movement of the target arm.

25. The method of target shooting of claim 18, wherein the center support member is positioned approximately vertically.

26. The method of target shooting of claim 18, wherein the center support member is positioned approximately horizontally.

27. The method of target shooting of claim 18, wherein the step of firing the first projectile is performed by a first user and the step of firing the second projectile is performed by a second user.

28. The method of target shooting of claim 18, wherein the steps of firing the first projectile and firing the second projectile are performed by a single user.

* * * * *